United States Patent [19]

Schloz

[11] Patent Number: 4,598,870

[45] Date of Patent: Jul. 8, 1986

[54] DEVICE FOR THE POWDER-DUSTING OF MOVING OBJECTS, PARTICULARLY FLAT SUBSTRATES

[75] Inventor: Gerhard Schloz, Leinfelden-Echterdingen, Fed. Rep. of Germany

[73] Assignee: Weitmann & Konrad GmbH & Co. KG, Fed. Rep. of Germany

[21] Appl. No.: 642,783

[22] Filed: Aug. 21, 1984

[30] Foreign Application Priority Data

Aug. 25, 1983 [DE] Fed. Rep. of Germany ..... 3330665

[51] Int. Cl.[4] ..... B05B 5/02

[52] U.S. Cl. ..... 239/696; 239/295; 239/690; 239/707

[58] Field of Search ..... 239/696, 690, 704–708, 239/295

[56] References Cited

U.S. PATENT DOCUMENTS

| | | | |
|---|---|---|---|
| 3,059,613 | 10/1962 | Nakaya | 239/706 |
| 3,393,662 | 7/1968 | Blackwell | 239/706 |
| 3,937,401 | 2/1976 | Luderer et al. | 239/707 |
| 4,055,300 | 10/1977 | Binoche | 239/707 |
| 4,066,041 | 1/1978 | Buschor et al. | 239/708 |
| 4,114,810 | 9/1978 | Masuda | 239/706 |
| 4,440,349 | 4/1984 | Sickles et al. | 239/705 |

FOREIGN PATENT DOCUMENTS

| | | | |
|---|---|---|---|
| 1247908 | 8/1967 | Fed. Rep. of Germany | 239/295 |
| 2646798 | 12/1982 | Fed. Rep. of Germany | 239/706 |

*Primary Examiner*—Joseph F. Peters, Jr.
*Assistant Examiner*—Michael J. Forman
*Attorney, Agent, or Firm*—Leydig, Voit & Mayer, Ltd.

[57] ABSTRACT

The invention relates to a device for the powder-dusting of moving objects, particularly flat substrates in the form of webs and sheets of paper, plastic or textile with a nozzle housing made of electrically insulating material, with at least one nozzle provided on the housing for releasing a powder air stream laden with dusting powder and with metallic electrodes and counter-electrodes disposed on the housing for producing an electrical high-voltage field. To obtain a powder air stream with powder particles as neutral as possible, it is envisaged that at least one electrode and a counter-electrode cooperating with the latter are disposed on the outside of the housing in the vicinity of the nozzle whereby an electrical high AC voltage is applied to the electrode and counter-electrode, whereby, after being released from the nozzle, the powder air stream penetrates the thus produced high AC voltage field on the outside of the housing.

9 Claims, 5 Drawing Figures

11a
11b
11c
11d
11e
11f
2
3
4
5
1
28
24
8
2
26
32
27

B
A
1
11f
11e
11d
14
9
12
15
16
25
4
3
13
22
23
29
24
31
30
6
7
8

DEVICE FOR THE POWDER-DUSTING OF MOVING OBJECTS, PARTICULARLY FLAT SUBSTRATES

The invention relates to a device for the powder-dusting of moving objects, particularly flat substrates in the form of webs and sheets of paper, plastic or textile with a nozzle housing made of electrically insulating material, with at least one nozzle provided on the housing for releasing a powder air stream laden with dusting powder and with metallic electrodes and counter-electrodes disposed on the housing for producing an electrical high-voltage field.

In a known device of this kind (DE-PS 26 46 798) the powder particles are charged inside the nozzle housing using an electrical DC voltage field of certain polarity and are then in this state sprayed onto the moving object. However, it has become apparent that as they are released from the nozzle some of the charged powder particles again lose or even change their charge as a result of friction on the walls of the nozzle duct with the result that it is often not possible to set stable, reproducible conditions. In particular, the charge also largely depends on the kind of powder, namely, for example, on whether the powder is a mineral or an organic substance. There is also the difficulty that the moving object which is to be powder-dusted is also electrically charged as a result of unavoidable friction during conveying. In particularly unfavourable, usually totally unforeseeable cases, this can lead to a state of affairs where both the object and the powder particles have like electrical charges which repel each other so that only a very poor degree of powder-dusting is obtainable. The non-bound powder then strays in the machine conveying the objects, for example a printing press, and contaminates the latter and its surroundings, which results in an increased outlay on cleaning and in increased wear on the machine.

The object of the invention is to remedy the depicted deficiencies and, while obtaining a high powder-dusting efficiency, to prevent undesired, stray quantities of powder remote from the surface of the object being powder-dusted.

The object of the invention is achieved in that at least one electrode and a counter-electrode cooperating with the latter are disposed on the outside of the housing in the vicinity of the nozzle whereby an electrical high AC voltage is applied to the electrode and counter-electrode, whereby, after being released from the nozzle, the powder air stream penetrates the thus produced high AC voltage field on the outside of the housing.

The invention thus proceeds from the realization that, in the final analysis, it is better not to spray charged powder particles, but to spray neutral powder particles onto the objects which are to be powder-dusted. This is because the degree of powder-dusting can thus easily be set and reproduced. To produce a neutral powder stream, the powder particles are firstly directed through the high voltage field on the outside of the nozzle housing so that the charges can no longer change as a result of friction in the nozzle ducts. The use of a high AC voltage field results in charges of both polarities which can be neutralized again on the way to the object being powder-dusted.

The invention is described in further detail in the following description of a preferred embodiment of the invention with reference to the appended drawings.

Figure 2:
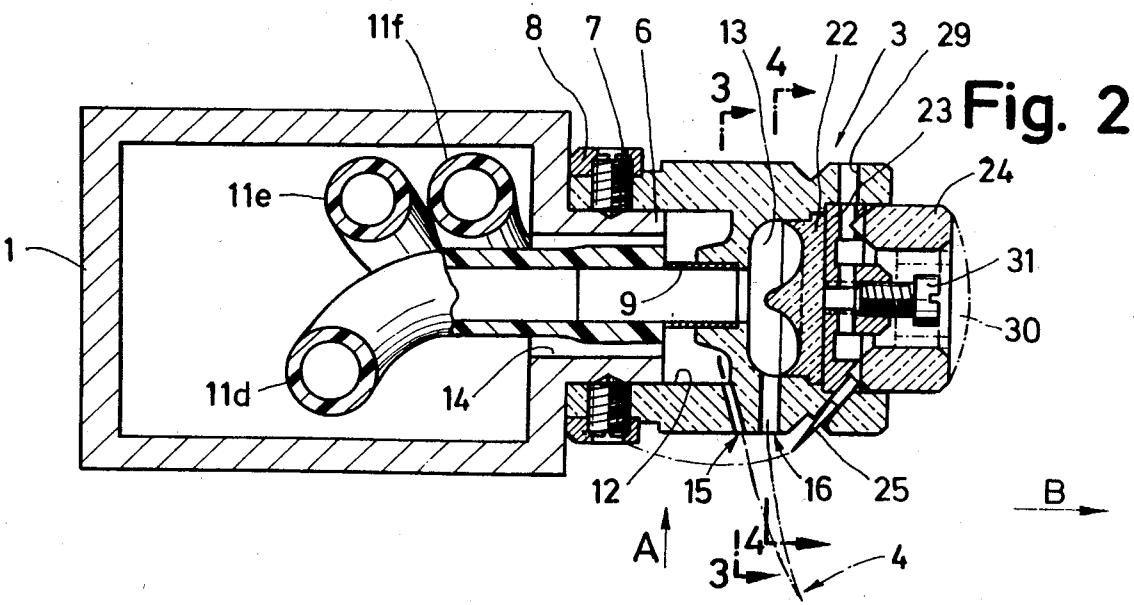
FIG. 2 shows a partial sectional view on line 2—2 in FIG. 1.
Figure 3:
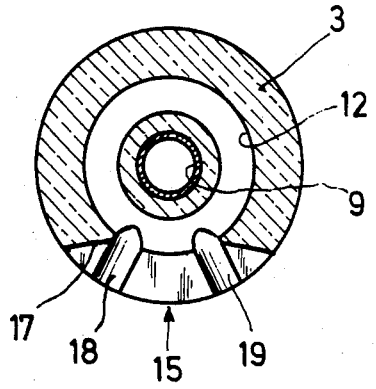
Figure 4:
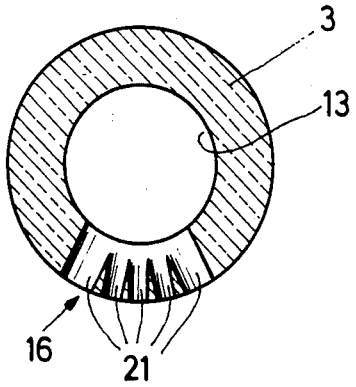
Figure 5:
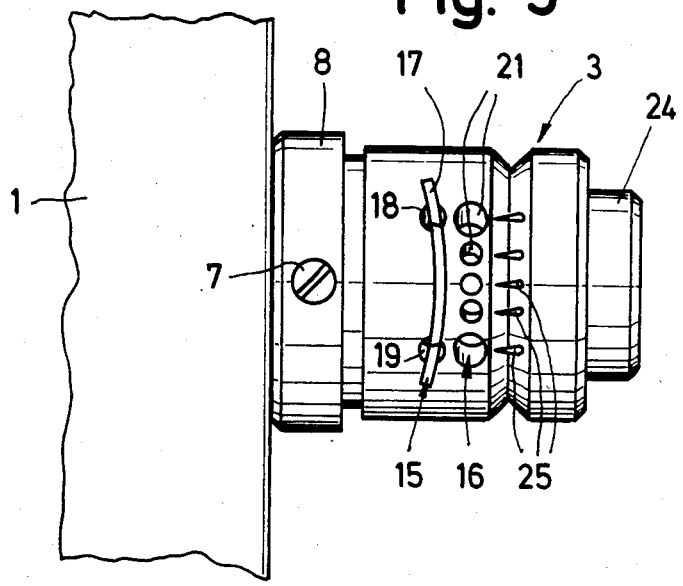

FIGS. 3 and 4 show sectional views on lines 3—3 and 4—4 respectively in FIG. 2; and FIG. 5 shows a bottom view of the device in the direction of arrow A in FIG. 2.

Figure 1:
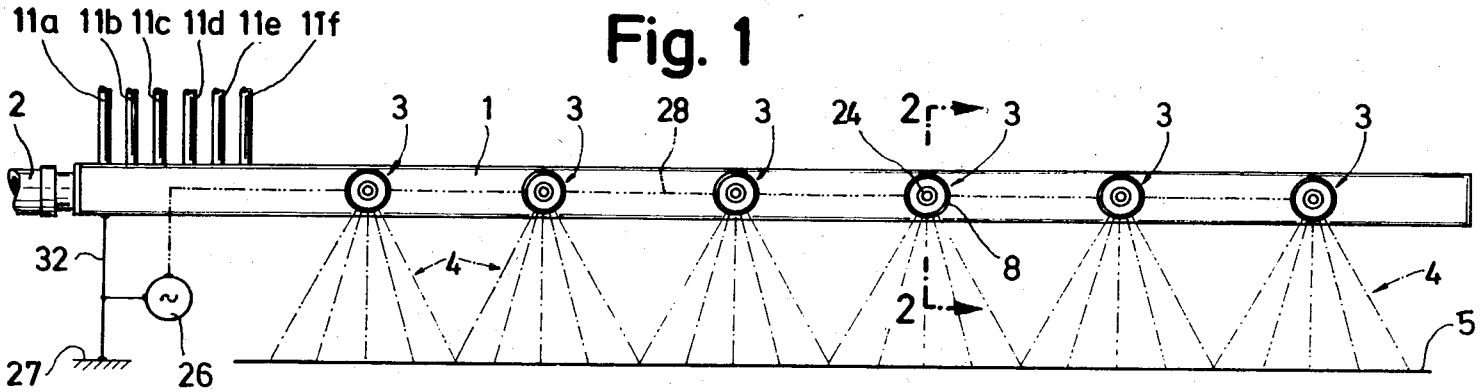
FIG. 1 shows a diagrammatic front view of a device for the powder-dusting of moving objects.

The device shown in diagrammatic form in FIG. 1 for the powder-dusting of moving objects, particularly flat substrates in the form of webs and sheets of paper, plastic or textile can be used for example in a printing press. It comprises a rectangular section tube 1 (see also the sectional view in FIG. 2), one end of which (on the right in FIG. 1) is closed while the opposite end is connected by a line 2 to a known compressed-air source which is not shown. Disposed on the front side of the tube 1 are several nozzle housings 3, of which one is shown in section in FIG. 2. The nozzle housings are made of electrically insulating material, preferably plastic, and each release a fan-shaped powder air stream 4 which strikes an object which is to be powder-dusted, for example a freshly printed paper sheet 5. The sheet 5 is fed along perpendicularly to the plane of the drawing in FIG. 1 and is dusted with powder virtually over its entire width. The distance between the tube 1 and the sheet 5 may, for example, may be between 8 and 20 cm.

FIG. 2 shows the nozzle housing 3 in section whereby the feed direction of the sheet 5 is indicated by arrow B. The nozzle housing 3 which is basically circularly cylindrical in cross section is slid onto a tubular extension 6 of the rectangular section tube 1 and is held down by screws 7. In the region of the projection 6 the nozzle housing is surrounded by a metal ring 8 which serves (in manner yet to be described) as counter-electrode and which, by means of the metal screws 7, has an electrically conducting connection to the rectangular section tube 1 which is likewise made of metal. Coaxially and rigidly disposed in the nozzle housing 3 is a tube 9 onto which the end of a flexible hose line **11*d* is fitted in sealed manner. The nozzle housing 3 contains two separate chambers 12 and 13. The chamber 12 is connected, firstly, to the interior of the tube 1 by means of a ring line 14 concentrically surrounding the hose line 11*d* and, secondly, to atmosphere by means of a first nozzle 15. The compressed air introduced into the tube 1 through the line 2 is released from the nozzle 15 in a diagonally downward direction from the nozzle housing. The second chamber 13 is connected, firstly, to the hose line 11*d* and, secondly, to atmosphere by means of a second nozzle 16. A powder air stream which is laden with dusting powder is introduced through the hose line 11*d* into the chamber 13 from where it then escapes basically vertically downward to unite with the diagonal compressed-air stream from the nozzle 15**. The united streams—now in the form of the fan-shaped configuration shown in FIG. 1—reach the object which is fed along in the direction of arrow B.

It has proved advantageous to release the compressed-air stream supplied from the nozzle 15 through tube 1 at a velocity between about 30 and 60 m/s while the powder air stream escaping from the nozzle 16 has a velocity between about 1 and 10 m/s in the area between the nozzle and its entry into the compressed-air stream escaping from the nozzle 15. The united streams then strike the object to be powder-dusted at a velocity between about 5 and 20, preferably 8 and 12 m/s. As already stated, the object is moved past at a distance of about 8 to 20 cm below the nozzle.

As can be seen from FIG. 3 and 5, the nozzle 15 leading out of the chamber 12 is partially in the form of a curved slit 17 which extends in places into two holes 18, 19. The nozzle 16, see FIG. 4 and 5, comprises several outlet openings 21 of different diameter.

Inserted into the nozzle housing 3 through an electrically insulating wall 22 and separated from the chamber 13 is a metal insert 23 which is held by a bonded-in ring 24 of insulating material. Several metal tips 25 are connected to the insert 23 such as to electrically conduct. These metal tips 25 are disposed basically parallel to the outlet openings 21 of the nozzle 16 and point diagonally downward. The metal tips 25 serve as electrodes and, in cooperation with the aforementioned ring 8 which serves as a counter-electrode, produce a corona discharge when they are connected to a high-voltage source. The high-voltage source is shown schematically in FIG. 1 and has the reference character 26. It is connected, firstly, to ground 27 and, secondly, to the metal tips 25 by means of a dash-dotted line 28. The line 28 is connected through a hole 29 in the nozzle housing 3 and in the metal insert 23. The metallic conductor of the line 28 is introduced into the hole 29 and is fixed by means of a screw 31 likewise located in the insert 23. The screw 31 may be covered by a dash-dotted protective cap 30 made of insulating material. The line 28 runs consecutively to the metal tips 25 of the individual nozzle housings 3 (see FIG. 1). The rectangular section tube 1 is likewise connected to ground by a line 32 (FIG. 1) so that the ring 8 which serves as counter-electrode is thus also grounded. The voltage source 26 is a high voltage AC source.

Shown in FIG. 1 are a total of six hose lines 11*a* to 11*f* which join into the tube 1 and which each lead to one of the nozzle housings 3. In addition to hose line 11*d*, FIG. 2 also shows the hose lines 11*e* and 11*f*. The hose lines 11*a* to 11*f* are connected to a "powder air source" of known kind from which a powder-laden air steam is fed through these lines to the nozzles 16.

The electrical AC field which extends like an arc between the metal tips 25 and the metal ring 8 is penetrated by the powder air stream escaping from nozzle 16. The powder particles which are entrained in this stream are thus alternately positively and negatively charged. After the powder air stream has united with the compressed-air steam escaping from nozzle 15, the powder particles of different charge polarity are mixed through turbulence so that they neutralize each other again. In this way it is ensured, that, in the final analysis, electrically neutral powder particles strike the object which is being powder-dusted. Above all, it is important that the electrical high voltage field between the metal tips 25 and the metal ring 8 runs along the outside of the nozzle housing 3 and that the powder particles are electrically charged in this field not until they have escaped from nozzle 16. In this way the charged powder particles need not flow through any nozzle ducts in which they might reverse their electrical charge.

The device described here is only an especially preferred embodiment of the invention. It is not absolutely necessary that the powder stream striking the object to be powder-dusted be composed of two partial streams as described. In principle, it is also possible to direct one single powder-laden air stream through an electrical AC high voltage field which is built up on the outside of a nozzle. This also results in neutral powder particles.

In the embodiment which has been presented and described, the powder air stream is composed of two partial streams because in this way the stream entraining the powder particles and escaping from nozzle 16 can be made to flow more slowly and, consequently, there is greater certainty that it will be electrically charged. Then, due to the faster-flowing compressed-air stream escaping from nozzle 15, the united stream still has the desired high velocity at the point at which it strikes the object being powder-dusted.

In other embodiments of the invention it is possible, instead of the metal tips 25, also to use a sharp blade situated opposite the nozzle 16 to act as electrode for producing a corona discharge.

The degree of neutralization of the powder air stream applied to the moving object (paper sheet 5) depends on how often the electrical AC field between the metal tips 25 and the metal ring 8 changes its polarity while it is being penetrated by a powder air stream at a certain velocity. The faster the powder air stream escapes from the nozzle 16, the higher the frequency should be. As a rule, it will be sufficient to use a voltage source 26 operating at the usual mains frequency of 50 Hz. In the case of extremely fast powder air streams it is also possible to use high voltage fields of higher frequency.

What is claimed is:

1. Device for the powder-dusting of moving objects, particularly flat substrates in the form of webs and sheets of paper, plastic, or textile, comprising a nozzle housing made of electrically-insulating material, a first chamber in said housing being connected by first conduit means to a compressed-air source means, a second chamber in said housing being connected by second conduit means to a powder-air-stream source means, a first nozzle on said housing connecting the first chamber to atmosphere and directed toward the substrate such that a first stream of compressed air flows through the first nozzle to atmosphere with a first velocity, a second nozzle on said housing connecting the second chamber to atmosphere and directed toward the substrate such that a second stream containing said mixture of powder and compressed air flows through the second nozzle to atmosphere with a second velocity, the second velocity being lower than the first velocity, the first nozzle being directed, relative to the second nozzle, in such a manner that said first stream unites with said second stream at a location spaced from the housing with the result that a combined powder/compressed air stream strikes the object to be powder-dusted, the device further comprising at least one electrode and a counter-electrode disposed on the outside of said housing on opposite sides of said second nozzle, a high voltage AC source connected to said electrode and counter electrode to create an AC field extending between said electrode and counter-electrode, said electrical AC field penetrating said second stream flowing out from said second nozzle and containing said dusting powder, at a location prior to the uniting of the first and second streams whereby a substantially neutral net charge is imparted to the lower velocity powder stream prior to its combination with the higher velocity compressed-air stream.

2. Device as claimed in claim 1, wherein said electrode is in the form of a tip.

3. Device as claimed in claim 1, wherein said electrode is in the form of a blade.

4. Device as claimed in claim 1, wherein said counter-electrode is in the form of a ring enclosing the nozzle housing.

5. Device as claimed in claim 1, wherein said first nozzle is in the form of a slit.

6. Device as in claim 1, wherein said nozzle housing is circularly cylindrical in form, said second nozzle for releasing the powder air stream lies in a radial plane of said housing and said electrode and said first nozzle for releasing the compressed-air stream are disposed on the housing on either side of said powder-air escape nozzle and such that they converge on each other.

7. Device as in claim 1, wherein the frequency of the high AC voltage field is adaptable to the velocity of said powder-air stream.

8. Device as in claim 1, wherein the velocity of said compressed air stream supplied from said first nozzle is between 30 and 60 meters/second (m/s), the velocity of said powder-air stream supplied from said second nozzle is between 1 and 10 m/s, resulting in a velocity of the united first and second streams of between about 5 and 20 m/s.

9. Device as in claim 8, wherein the velocity of the united first and second streams is between 8 and 12 m/s.

* * * * *